US005890371A

United States Patent [19]

Rajasubramanian et al.

[11] Patent Number: 5,890,371

[45] Date of Patent: Apr. 6, 1999

[54] HYBRID AIR CONDITIONING SYSTEM AND A METHOD THEREFOR

[75] Inventors: Sathya Rajasubramanian, Arlington; Roger S. DeVilbiss, Dallas; Thomas C. Dedmon, Lewisville; Tony M. Quisenberry, Highland Village; Ronald Borman, Dallas; Allen D. Boger, Jr., Argyle, all of Tex.

[73] Assignee: Thermotek, Inc., Carrollton, Tex.

[21] Appl. No.: 893,851

[22] Filed: Jul. 11, 1997

Related U.S. Application Data

[63] Continuation-in-part of Ser. No. 679,126, Jul. 12, 1996.

[51] Int. Cl.[6] ..... F25B 21/02; F25B 25/00

[52] U.S. Cl. ..... 62/259.2; 62/332; 62/3.2; 165/104.21

[58] Field of Search ..... 62/3.2, 3.7, 259.2, 62/332; 165/104.21, 104.33

[56] References Cited

U.S. PATENT DOCUMENTS

| | | | |
|---|---|---|---|
| 2,416,152 | 2/1947 | Braun | 175/366 |
| 2,713,655 | 7/1955 | Grubman | 317/234 |
| 3,040,538 | 6/1962 | Alsing | 62/3 |
| 3,087,309 | 4/1963 | Toulmin, Jr. | 62/3 |
| 3,226,602 | 12/1965 | Elfving | 62/3 |
| 3,626,704 | 12/1971 | Coe, Jr. | 62/3 |
| 3,732,919 | 5/1973 | Wilson | 165/110 |
| 4,290,273 | 9/1981 | Meckler | 62/148 |
| 4,301,658 | 11/1981 | Reed | 62/3 |
| 4,306,613 | 12/1981 | Christopher | 165/32 |
| 4,328,677 | 5/1982 | Meckler | 62/124 |
| 4,347,474 | 8/1982 | Brooks et al. | 323/224 |
| 4,449,576 | 5/1984 | Baum et al. | 165/104.33 |
| 4,463,569 | 8/1984 | McLarty | 62/3 |
| 4,478,277 | 10/1984 | Friedman et al. | 165/185 |
| 4,490,982 | 1/1985 | Christmas | 62/3 |
| 4,631,728 | 12/1986 | Simons | 372/38 |

(List continued on next page.)

FOREIGN PATENT DOCUMENTS

| | | |
|---|---|---|
| 0 478 204 | 4/1992 | European Pat. Off. . |
| 37 30 830 A | 3/1989 | Germany . |
| 4036210 | 5/1992 | Germany . |
| 57-138415 A | 8/1982 | Japan . |
| 188855 | 11/1982 | Japan . |
| 7-106640 A | 4/1995 | Japan . |
| 8-136422 A | 5/1996 | Japan . |
| 2 260 191 | 4/1993 | United Kingdom . |
| 2260191 | 4/1993 | United Kingdom . |

*Primary Examiner*—William Doerrler
*Attorney, Agent, or Firm*—Jenkens & Gilchrist, P.C.

[57] ABSTRACT

A system for conditioning the air within an enclosure which houses heat producing equipment. The system includes a passive heat removal system, for precooling the air, and a thermoelectric temperature control system used in conjunction with the passive heat removal system to achieve additional cooling, temperature control and heating. The passive heat removal system includes a heat pipe system. A power control system includes a programmable control means which receives signals, from a temperature sensor, which are indicative of the temperature of the air in the enclosure. Based upon these signals, the power control system controls the activation of thermoelectric devices in the thermoelectric temperature control system and controls the activation of fans to remove a desired amount of heat from the air in the enclosure and discharge the unwanted heat to the outside air. A switching device operates to apply battery power to the power control system if the electrical power source for the thermoelectric temperature control system fails. A polarity reversal circuit reverses the DC polarity of the DC voltage applied to the thermoelectric devices to reverse the heat pumping of the thermoelectric devices in the situation where the air in the enclosure needs to be heated. Circuitry and sensors are provided to monitor the speed of the fans to detect any failure of a fan. A current control circuit supplies power to and temperature control of thermoelectric cooling devices.

46 Claims, 7 Drawing Sheets

U.S. PATENT DOCUMENTS

| | | | |
|---|---|---|---|
| 4,685,081 | 8/1987 | Richman | 365/1 |
| 4,709,323 | 11/1987 | Lien | 363/97 |
| 5,035,052 | 7/1991 | Suzuki et al. | 29/890.046 |
| 5,079,618 | 1/1992 | Franworth | 357/81 |
| 5,097,829 | 3/1992 | Quisenberry | 128/400 |
| 5,128,517 | 7/1992 | Bailey et al. | 219/506 |
| 5,172,689 | 12/1992 | Wright | 128/400 |
| 5,174,121 | 12/1992 | Miller | 62/3.7 |
| 5,190,032 | 3/1993 | Zacoi | 128/400 |
| 5,197,291 | 3/1993 | Levinson | 62/3.2 |
| 5,197,294 | 3/1993 | Galvan et al. | 62/3.62 |
| 5,279,128 | 1/1994 | Tomatsu et al. | 62/3.4 |
| 5,315,830 | 5/1994 | Doke et al. | 62/3.2 |
| 5,371,665 | 12/1994 | Quisenberry et al. | 363/89 |
| 5,450,727 | 9/1995 | Ramirez et al. | 62/3.7 |
| 5,505,046 | 4/1996 | Nelson et al. | 62/3.6 |
| 5,528,485 | 6/1996 | DeVilbiss et al. | 363/89 |
| 5,561,981 | 10/1996 | Quisenberry et al. | 62/3.7 |
| 5,566,062 | 10/1996 | Quisenberry et al. | 363/89 |
| 5,588,300 | 12/1996 | Larsson et al. | 62/3.61 |
| 5,648,716 | 7/1997 | DeVilbiss et al. | 320/32 |

HYBRID AIR CONDITIONING SYSTEM AND A METHOD THEREFOR

This application is a Continuation-in-Part of copending U.S. patent application Ser. No. 08/679,126 filed Jul. 12, 1996.

BACKGROUND OF THE INVENTION

1. Field of the Invention

The present invention relates to air conditioning systems, and more particularly, but not by way of limitation, to a passive heat removal system in conjunction with a thermoelectric temperature control system for conditioning the air in an enclosure which shelters heat producing equipment such as a microwave repeater station, or electronic equipment sheltered in a remote location, or other sealed enclosure such as an automobile.

2. History of the Prior Art

Heat producing equipment such as, for example, remote microwave repeater stations or remote cell sites for cellular phone systems, are frequently subjected to very high ambient temperatures which may have an adverse affect on the life, reliability and/or performance of the equipment. Several systems are available for the cooling or conditioning of the air in the electronic enclosures. The technology used for cooling relate to and include passive cooling systems, conventional compressor-based systems and thermoelectric systems.

In passive cooling systems, the air to be cooled is circulated over an air-to-air heat exchanger, which includes folded, finned heat exchangers, heat pipes, etc. The heat is then exchanged with the outside ambient air. As the amount of heat to be removed from the enclosure increases, the size of the air-to-air heat exchanger must be increased in size, which may be a drawback. Another drawback of the passive cooling system is that the amount of heat the system can remove from the enclosure is determined by the ambient temperatures of the air surrounding the enclosure. Therefore, if the ambient temperature is at, for example, 55° C., the temperature inside the enclosure can only be lowered to a temperature slightly above the ambient temperature by the passive cooling system.

Compressor based systems function by using a refrigerant and the cooling function is achieved by the compression and expansion of the refrigerant. The compressor based systems are efficient but are bulky, have large maintenance costs and consume large amounts of electricity. Also, all the cooling is done actively, which may not be necessary when, for example, the ambient outside air is sufficiently cool.

Thermoelectric temperature control systems use thermoelectric devices that pump heat using the Peltier effect. The thermoelectric devices are highly reliable and very economical at low wattage applications. As the number of watts to be removed are increased, the cost of this type of system increases as the cost is directly related to the number of thermoelectric devices that are needed for the particular function. The cooling capacity may be limited because of the power supply requirements since more thermoelectric devices necessitates more power.

The most typical thermoelectric device incorporates a thermoelectric module/component that utilizes electrical current to absorb heat from one side of the module and dissipate that heat on the opposite side. If the current direction is reversed, so is the heat pumping. Generally, cold sides and hot sides are developed necessitating an effective means of removing or adding heat from or to a solid, liquid or a gas (typically air).

It would be advantageous to provide a system which would condition the air in the electronic enclosures in an improved manner which would be low cost, reliable, efficient and low maintenance.

The present invention provides such an improvement over the prior art by eliminating the need for refrigerant while providing high energy efficiency with improved cooling capacity, low maintenance, low cost and low noise, and which is light weight and compact.

SUMMARY OF THE INVENTION

The present invention relates to a method of and apparatus for a hybrid air conditioning system. More particularly, one aspect of the present invention comprises a low cost passive heat removal system in conjunction with a thermoelectric temperature control system. The passive heat removal system precools the air prior to the thermoelectric temperature control system, which performs the subsequent cooling and temperature control, if needed, of the air in an enclosure which houses the heat producing equipment. The thermoelectric temperature control system is operated only when needed which results in a large energy cost savings. Another aspect of the present invention comprises a power control system which includes a programmable control means to receive signals, from a temperature sensor, which are indicative of the temperature of the air in the enclosure which houses heat producing equipment. Based upon these signals, the power control system controls the activation of the thermoelectric devices and fans to remove a desired amount of heat from the air in the enclosure and discharge the unwanted heat to the outside air. The programmable control means comprises a microprocessor and associated software.

Another aspect of the present invention comprises a switching device operatively connected between an electrical power source in the enclosure which houses heat producing equipment and a power control system. The switching device operates to apply battery power to the power control system if the electrical power source fails.

Another aspect of the present invention comprises a polarity reversal circuit operatively connected between the power control system and the thermoelectric devices to reverse the heat pumping of the thermoelectric devices in the situation where the air in the enclosure housing the heat producing equipment needs to be heated.

Another aspect of the invention comprises detection circuitry operatively connected between the fans and the programmable control means to detect the loss of proper operation of any of the fans.

Another aspect of the invention comprises fan speed control circuitry operatively connected between the fans and the programmable control means to maximize operational life of the fans.

Another aspect of the invention comprises a current control circuit with a buck-boost topology for supplying power to thermoelectric cooling devices and improved temperature control of the thermoelectric cooling devices. A buck or boost only could also be used.

Another aspect of the invention comprises a method of conditioning air in a process which utilizes the apparatus described above.

BRIEF DESCRIPTION OF THE DRAWINGS

Other advantages and features of the invention will become more apparent with reference to the following detailed description of a presently preferred embodiment thereof in connection with the accompanying drawings, wherein like reference numerals have been applied to like elements, in which.

DETAILED DESCRIPTION

Figure 1:
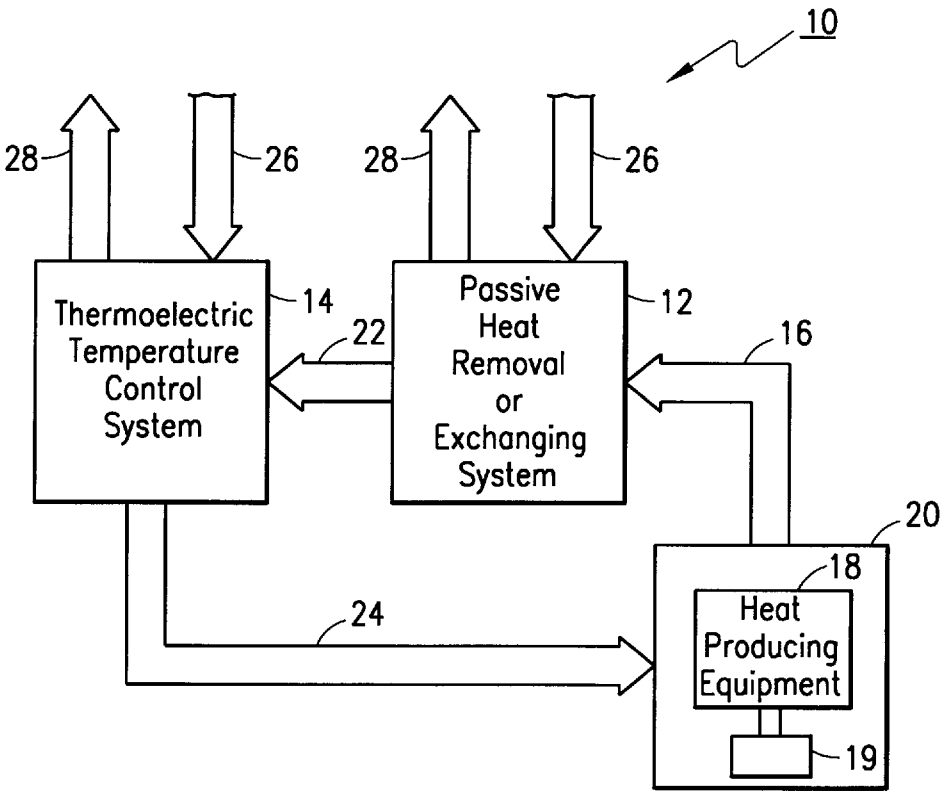
FIG. 1 is a block diagram showing the air flow between the present invention and the heat producing equipment.

Referring now to the drawings, and in particular to FIG. 1, the hybrid air conditioning system according to the present invention is referred to generally by reference numeral 10. Hybrid air conditioning system 10 comprises a passive heat removal or exchanging system 12 and a thermoelectric temperature control system 14. The warm or heated air 16, which is heated by the heat producing equipment 18 located in enclosure 20 and powered by a DC voltage from electrical power source 19, flows through and over the passive heat removal or exchanging system 12 where the warm or heated air 16 is precooled. The precooled air 22 then flows through and over the thermoelectric temperature control system 14. If the temperature of the precooled air 22 has not been reduced to the required temperature, the thermoelectric temperature control system 14 is activated and reduces or further cools the temperature of the precooled air 22 down to the required temperature. The cooled air 24, which has been cooled down to the required temperature, is sent back to enclosure 20. Ambient air 26 is drawn into both the passive heat removal or exchanging system 12 and the thermoelectric temperature control system 14 to assist in the heat removal process and is warmed and then the warmed ambient air 28 is exhausted back to the outside air. Neither the ambient air 26 or the warmed ambient air 28 is mixed with either the precooled air 22 or the cooled air 24. It will be appreciated that if the passive heat removal or exchanging system 12 is able to cool the warm or heated air 16 down to the required temperature, then the thermoelectric temperature control system 14 is not activated and is in a passive state for the cooling process.

Figure 2:
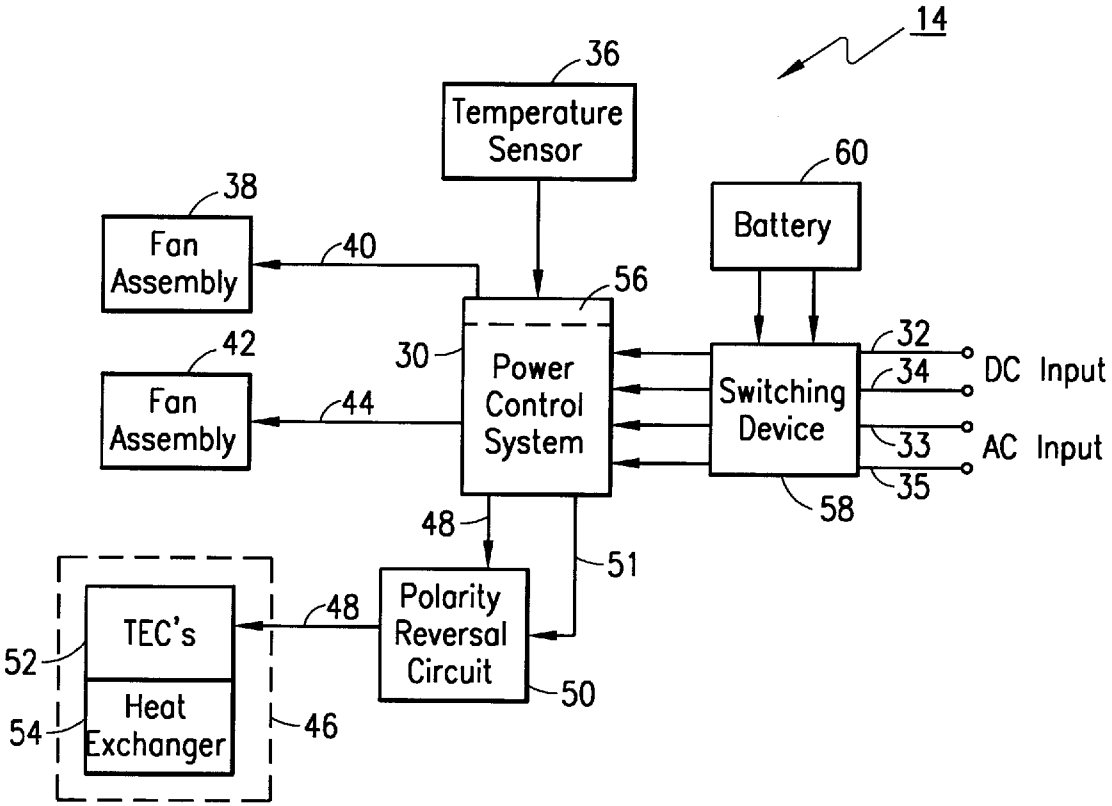
FIG. 2 is an electrical diagram of one embodiment of the thermoelectric temperature control system of the present invention.

Referring now to FIG. 2, one embodiment of the thermoelectric temperature control system 14 comprises a power control system 30 which receives input power, a DC voltage on leads 32 and 34 and an AC voltage on leads 33 and 35, from the electrical power source 19 in enclosure 20. Power control system 30 receives an input from temperature sensor 36, located in enclosure 20, which is indicative of the temperature of the air in enclosure 20. Power control system 30 provides the power and control thereof to fan assembly 38 via leads or cable 40 and also provides the power and control thereof to fan assembly 42 via leads or cable 44. It will be appreciated that each fan assembly can be controlled separately so that both fan assemblies can be on at the same time, both fan assemblies can be off at the same time and each fan assembly can be on at different times. Fan assembly 38 provides movement of the air, in enclosure 20, through a portion or section of the passive heat exchanging system 12, a portion or section of the thermoelectric temperature control system 14 and the enclosure 20 and will be shown in more detail in the discussion of FIG. 3. Fan assembly 42 provides movement of the ambient or outside air through a different portion or section of the passive heat exchanging system 12 and a different portion or section of the thermoelectric temperature control system 14 and will be shown in more detail in the discussion of FIG. 3.

Power control system 30 also provides the power and control thereof to thermoelectric assembly 46 via leads or cable 48 which passes through polarity reversal circuit 50. Polarity reversal circuit 50 reverses the polarity of the DC voltage applied to the thermoelectric assembly 46 if it is desired for the thermoelectric assembly 46 to provide heating rather that cooling. The position or state of the polarity reversal circuit 50 is determined and controlled by the signal sent from the power control system 30 via lead 51. Thermoelectric assembly 46 comprises thermoelectric devices 52 operatively mounted to heat exchanger 54. Power control system 30 comprises programmable control means 56 which receives the output from temperature sensor 36 and causes the power control system 30 to activate thermoelectric assembly 46 when needed. Programmable control means 56 comprises a microprocessor and associated software.

Power control system 30 can be one of two different designs which are available and will perform the necessary functions in the present invention. One design which can be used is that of the power control circuitry constructed in accordance with the teachings of U.S. Pat. No. 5,371,665, incorporated herein by reference. Another design which can be used is that of the current control circuit constructed in accordance with the teachings of U.S. patent application entitled "Current Control Circuit For Improved Power Application and Control of Thermoelectric Devices" filed Feb. 27, 1996 with Ser. No. 08/607,713 incorporated herein by reference.

As previously mentioned, power control system 30 receives a DC voltage on leads 32 and 34 which pass through switching device 58. Also connected to switching device 58 is battery 60. In the preferred embodiment, switching device 58 can be a normally open relay operatively connected such that if the DC power from the electrical power source 19 fails then switching device 58 will connect battery 60 to power control system 30 so the thermoelectric temperature control system 14 will remain operable if the operation of the fans are required. In the preferred embodiment, battery 60 will be either 24 volt DC or 48 volt DC.

Figure 3:
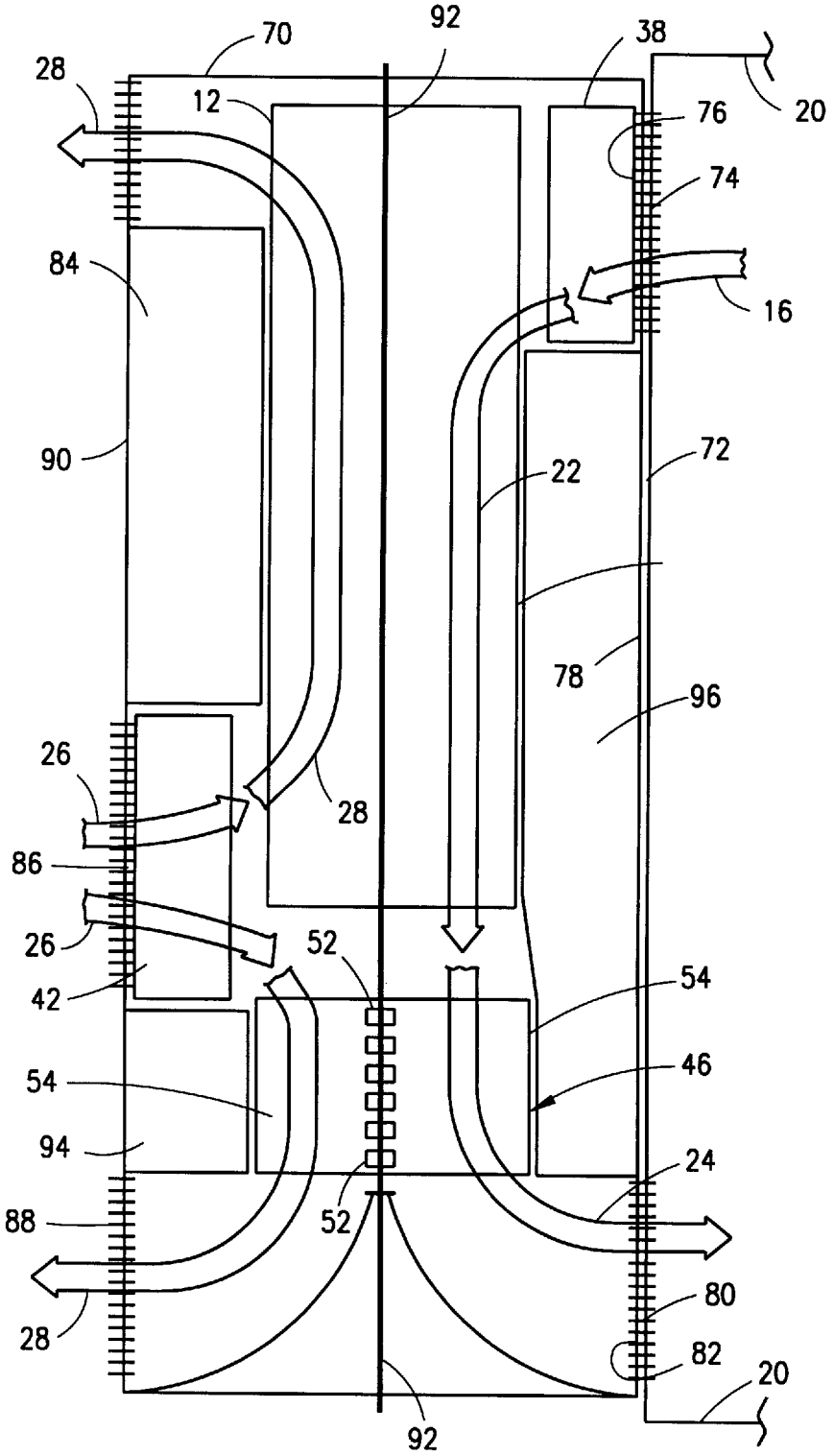
FIG. 3 is a side elevational view of one embodiment of the present invention mounted within a housing, with the side panel removed for viewing the elements, and with the housing installed against the enclosure which shelters the heat producing equipment.

Referring now to FIG. 3, one embodiment of the present invention is shown mounted in housing 70 with housing 70 being attached to or coupled to wall 72 of enclosure 20. Opening 74 is formed in wall 72 to align with opening 76 in wall 78 of housing 70. Opening 80 is formed in wall 72 of enclosure 20 to align with opening 82 in wall 78 of housing 70. Openings 84, 86 and 88 are formed in wall 90 of housing 70. Fan assembly 38 is operatively positioned with respect to openings 74 and 76 to draw air therethrough from enclosure 20 and to discharge air back into enclosure 20 through openings 82 and 80. Fan assembly 38 will include at least one fan. Fan assembly 42 is operatively positioned with respect to opening 86 to draw outside ambient air therethrough and to discharge the air back outside through openings 84 and 88. Fan assembly 42 will include at least one fan. Wall 92 in housing 70, together with the passive heat removal or exchanging system 12 and the thermoelectric assembly 46 prevents the air in and from enclosure 20 from mixing with the outside ambient air. The passive heat removal or exchanging system 12 is located in the upper portion of housing 70 with the thermoelectric devices 52 and heat exchanger 54 mounted in the lower portion of housing 70 and approximately in vertical alignment with the passive heat removal or exchanging system 12. In the preferred embodiment, heat exchanger 54 comprises an air-to-air heat exchanger with the usual finned array. It will be appreciated that the passive air-to-air heat exchanger may be formed by the extrusion process or the folding process of a heat conducting material. It will be appreciated that heat exchanger 54 extends through wall 92 with a predetermined portion of the unit being positioned on either side of wall 92 but mounted to prevent any air from passing from one side of wall 92 to the other side of wall 92. Depending upon the size of the passive air-to-air heat exchanger, wall 92 may exist as a wall only for the thermoelectric assembly 46 and exist as a mounting bracket for the passive heat removal or exchanging system 12, while still preventing the air in and from enclosure 20 from mixing with the outside ambient air. Power control system 30 is positioned above fan assembly 42. Baffles 94 and 96 together with wall 92 assist in directing the flow of air on both sides of wall 92.

It will be appreciated that the positions of the passive heat removal or exchanging system 12 and the thermoelectric devices 52 and heat exchanger 54 may be interchanged such that the thermoelectric devices 52 and heat exchanger 54 are mounted in the upper portion of housing 70 with the passive heat removal or exchanging system 12 mounted in the lower portion of housing 70 without departing from the spirit and scope of the present invention.

With reference to FIGS. 1–3, the operation of the present invention will be discussed. Upon activation of the heat producing equipment 18 and the thermoelectric temperature control system 14 by the electrical power source, the temperature sensor 36 begins to monitor the temperature within enclosure 20. When the signal to the power control system 30, from the temperature sensor 36, indicates that the temperature of the air within enclosure 20 has reached a first predetermined value, the microprocessor and software in the power control system 30 will cause the power control system 30 to activate fan assembly 38. The warm or heated air 16 will be drawn from enclosure 20, through openings 74 and 76, passed over that portion of the heat exchanger of passive heat removal or exchanging system 12 which resides on the enclosure 20 side of wall 92, passed over half of heat exchanger 54 of thermoelectric assembly 46 and then will be discharged back into enclosure 20 through openings 82 and 80. It will be appreciated that during the flow of the warm or heated air 16 some of the heat therein will be transferred to that portion of the heat exchanger of passive heat removal or exchanging system 12 which resides on the enclosure 20 side of wall 92 and then be transferred to that portion of the heat exchanger of passive heat removal system 12 which resides on the outside-air side of wall 92.

If the temperature of the warm or heated air 16 continues to increase, the signal from the temperature sensor 36 will indicate that the temperature of the air within enclosure 20 has reached a second predetermined value, and the power control system 30 will activate fan assembly 42. Fan assembly 42 will draw outside ambient air 26, through opening 86, which will be passed over that portion of the heat exchanger of passive heat removal or exchanging system 12 which resides on the outside-air side of wall 92 removing heat from the passive heat removal system 12 and expelling the warmed ambient air 28 to the outside through opening 84. Fan assembly 42 will also cause some outside ambient air 26 to pass over that half of heat exchanger 54 which resides on the outside-air side of wall 92 and to be discharged to the outside through opening 88.

If the temperature of the warm or heated air 16 continues to increase, the signal from the temperature sensor 36 will indicate that the temperature of the air within enclosure 20 has reached a third predetermined value, and the power control system 30 will activate the thermoelectric devices 52 which will cool the half of heat exchanger 54 which resides on the enclosure 20 side of wall 92. The activation of the thermoelectric devices 52 will further cool the precooled air 22. The power control system 30 will activate the thermoelectric devices 52 in a proportional manner to keep the air in enclosure 20 below the maximum allowed value. It will be appreciated that the power control system 30 may keep fan assembly 38 activate and running all the time depending upon the requirements of the operation and installation.

If the air in enclosure 20 becomes colder than a predetermined value as indicated by the signal from the temperature sensor 36 to the power control system 30, the power control system 30 will activate the polarity reversal circuit 50. This application of a polarity reversed voltage to the thermoelectric devices 52 will result in the heating of the half of heat exchanger 54 which resides on the enclosure 20 side of wall 92 which results in the air in enclosure 20 being heated above a predetermined value. It will be appreciated that either of both fan assembly 38 and fan assembly 42 may be activated, if necessary.

Figure 4:
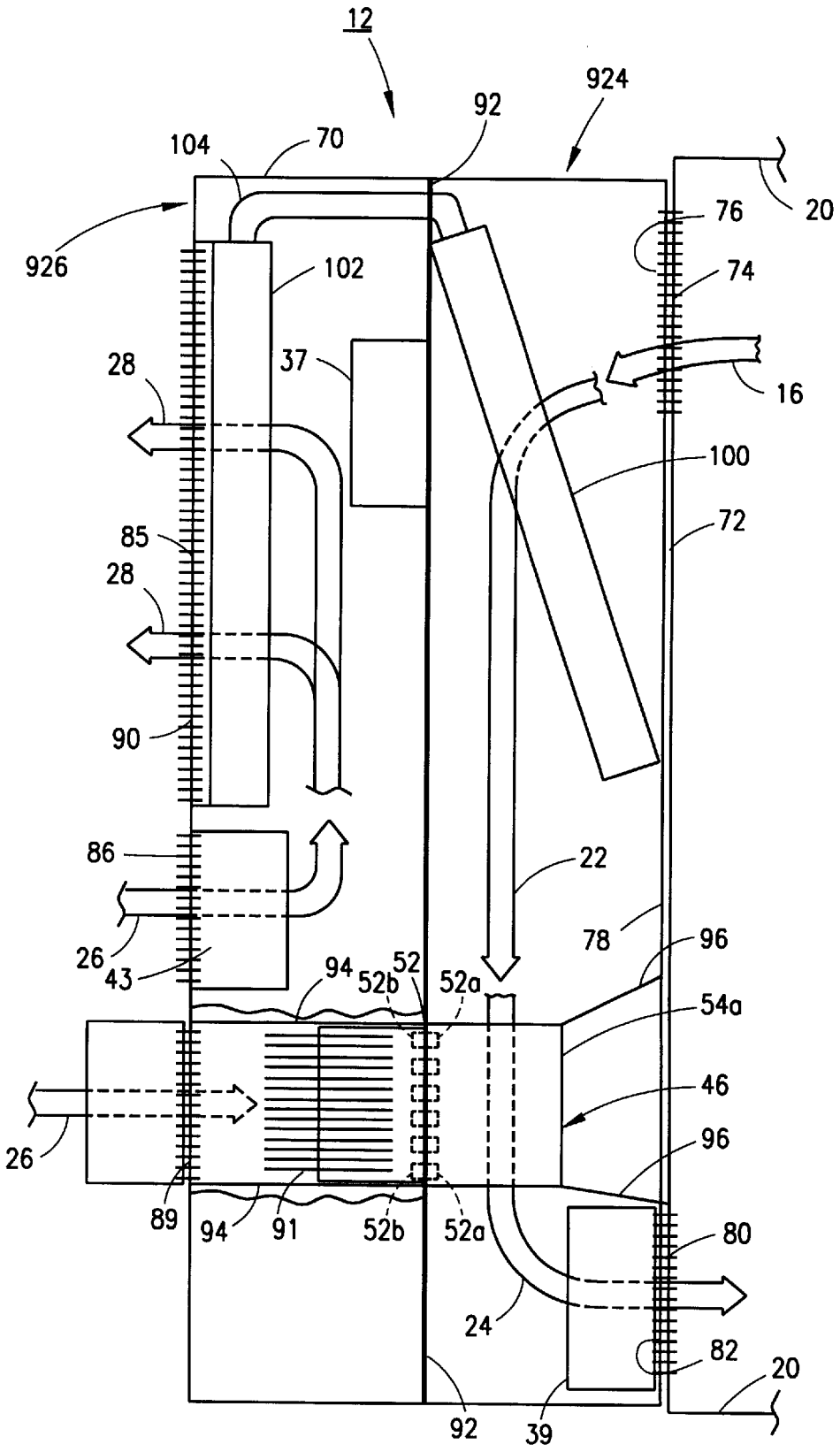
FIG. 4 is a side elevational view of another embodiment of the present invention mounted within a housing, with the side panel removed for viewing the elements, and with the housing installed against the enclosure which shelters the heat producing equipment.

Referring now to FIG. 4, there is shown another embodiment of the present invention illustrated as comprising a housing 70, a fan assembly 39, a fan assembly 43, a fan assembly 45, a passive heat exchanging system 12, a thermoelectric assembly 46, and power control system 37. A wall 92 separates the housing 70 into an internal chamber **92*a* having an outer internal chamber wall 78 and an external chamber 92*b* having an outer external chamber wall 90. The housing 70 attaches or couples to the wall 72 of the equipment enclosure 20. The wall 92 in housing 70 prevents the air in the internal chamber 92*a* from mixing with the air in the external chamber 92*b***.

Still referring to FIG. 4, the outer internal chamber wall 78 has an entrance opening 76 for receiving warm air 16 into the internal chamber **92*a* from the equipment enclosure 20 through an exit opening 74 in the equipment enclosure 20, and an exit opening 82 for returning cooled air 24 from the internal chamber 92*a* into the equipment enclosure 20 through an entrance opening 80 in the equipment enclosure 20. The fan assembly 39 is operatively positioned to draw the warm or heated air 16 from the enclosure through openings 74 and 76 from enclosure 20 and to discharge cooled air 24 back into enclosure 20 through openings 82 and 80. The fan assembly 39** will include at least one DC voltage fan.

Referring still to FIG. 4, the outer external chamber wall 90 of the housing 70 has an entrance opening 86 for receiving ambient air 26 into the external chamber 92*b*, and an exit opening 85 for returning air 24 from the external chamber 92*b* into the ambient air. The fan assembly 43 is operatively positioned to draw the outside ambient air 26 into the external chamber 92*b* through the opening 86 and to discharge the warmed ambient air 28 back outside through opening 85. The fan assembly 43 will include at least one DC voltage fan. The external chamber 92*b* of the housing 70 also has an entrance opening 89 in the outer external chamber wall 90 for receiving ambient air 26 into the external chamber 92*b*, and exit openings 92 for returning air 24 from the external chamber 92*b* into the ambient air. Baffles 94 in the external chamber 92*b* direct the air from the entrance opening 89 to the exit openings 91. The fan assembly 45 is operatively positioned to draw the outside ambient air 26 into the external chamber 92*b* through the opening 89 and to discharge the warmed ambient air 28 back outside through openings 91. The fan assembly 45 will include at least one DC voltage fan.

Still referring to FIG. 4, the passive heat removal or exchanging system 12 comprises a heat pipe or phase change type of heat exchanger which comprises a passive evaporator 100 connected by pipe 104 to a passive condenser 102. The passive heat removal or exchanging system 12 is located in the upper portion of housing 70. The passive evaporator 100 is positioned within the internal chamber 92*a* to receive the warm or heated air 16 from enclosure 20. The passive condenser 102 is positioned within the external chamber 92*b* to receive the ambient air 26. The passive heat exchanging system 12 is preferably a heat pipe system that passively transfers heat from a heat source to a heat sink where the heat is dissipated. The heat pipe or heat pipe system is preferably a vacuum-tight vessel that is evacuated and partially filled with an operational amount of working fluid, such as freon (H-134A), water, etc., which evaporates at a low temperature. As heat is directed into a portion of the device (the evaporator 100), the working fluid is vaporized creating a pressure gradient in the heat pipe system. This pressure gradient forces the vapor to flow along the pipe (the pipe 104) to the cooler section (the condenser 102) where it condenses, giving up its latent heat of vaporization. The working fluid is then returned to the evaporator by capillary forces developed in the heat pipe's porous wick structure, or by gravity. It can be seen that when the warm or heated air 16 passes over passive evaporator 100, the working fluid removes heat from the warm or heated air 16 and vaporizes to cause a pressure gradient which forces the vapor to the passive condenser 102. The vapor transfers heat to the passive condenser 102 which then gives up that heat to the ambient air 26, whereupon the vapor is condensed and the resulting working fluid is returned to the passive evaporator 100 without any power being applied to the heat pipe system.

Referring still to FIG. 4, the thermoelectric assembly 46 generally comprises thermoelectric devices 52 each having a first side 52*a* and a second side 52*b*, a first heat exchanger 54*a* connected to the first side 52*a* of the thermoelectric devices 52, and a second heat exchanger 54*b* connected to the second side 52*b* of the thermoelectric devices 52. The first heat exchanger 54*a* and the first side 52*a* of the thermoelectric devices 52 are disposed in the internal chamber 92*a*. Baffles 96 force the air 22 flowing through the internal chamber 92*a* to flow over the first heat exchanger 54*a* and the first side 52*a* of the thermoelectric devices 52 before exiting the internal chamber 92*a*. The second side 52*b* of the thermoelectric devices 52 and the second heat exchanger 54*b* are disposed within the baffles 94 located in the external chamber 92*b* such that ambient air 26 flowing into the external chamber 92*b* through opening 89 flows over the second side 52*b* of the thermoelectric devices 52 and the second heat exchanger 54*b* before exiting the external chamber 92*b* through openings 91 as the heated air 28.

Figure 5:
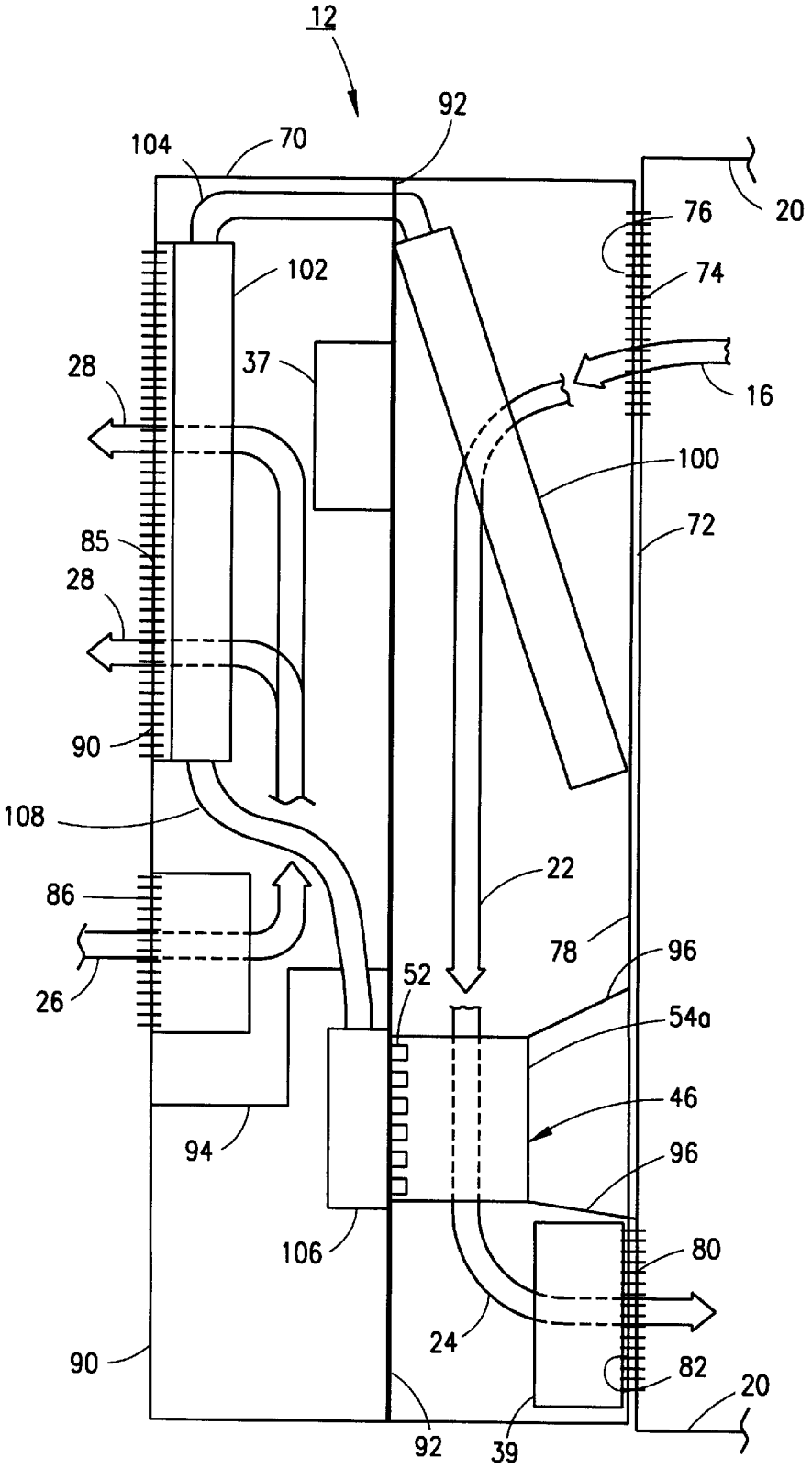
FIG. 5 is a side elevational view of yet another embodiment of the present invention mounted within a housing, with the side panel removed for viewing the elements, and with the housing installed against the enclosure which shelters the heat producing equipment.

Referring now to FIG. 5, yet another embodiment of the present invention is shown mounted in housing 70 with housing 70 being attached to or coupled to wall 72 of enclosure 20. It will be appreciated that this particular embodiment is very similar to that shown in FIG. 4 with the difference being that the portion of the air-to-air heat exchanger 54 located in the external chamber 92*b* has been replaced with a passive evaporator 106 and that the fan assembly 45 has been eliminated. Passive evaporator 106 is configured and positioned to remove heat from the second side 52*b* of the thermoelectric devices 52. The passive evaporator 106 is connected to passive condenser 102 by pipe 108. The passive evaporator 106 operates in conjunction with passive condenser 102 to remove heat from the second side 52*b* of the thermoelectric devices 52 in the same manner that the passive evaporator 100 operates in conjunction with passive condenser 102 to remove heat from warm or heated air 16 in the internal chamber 92*a*.

Figure 6:
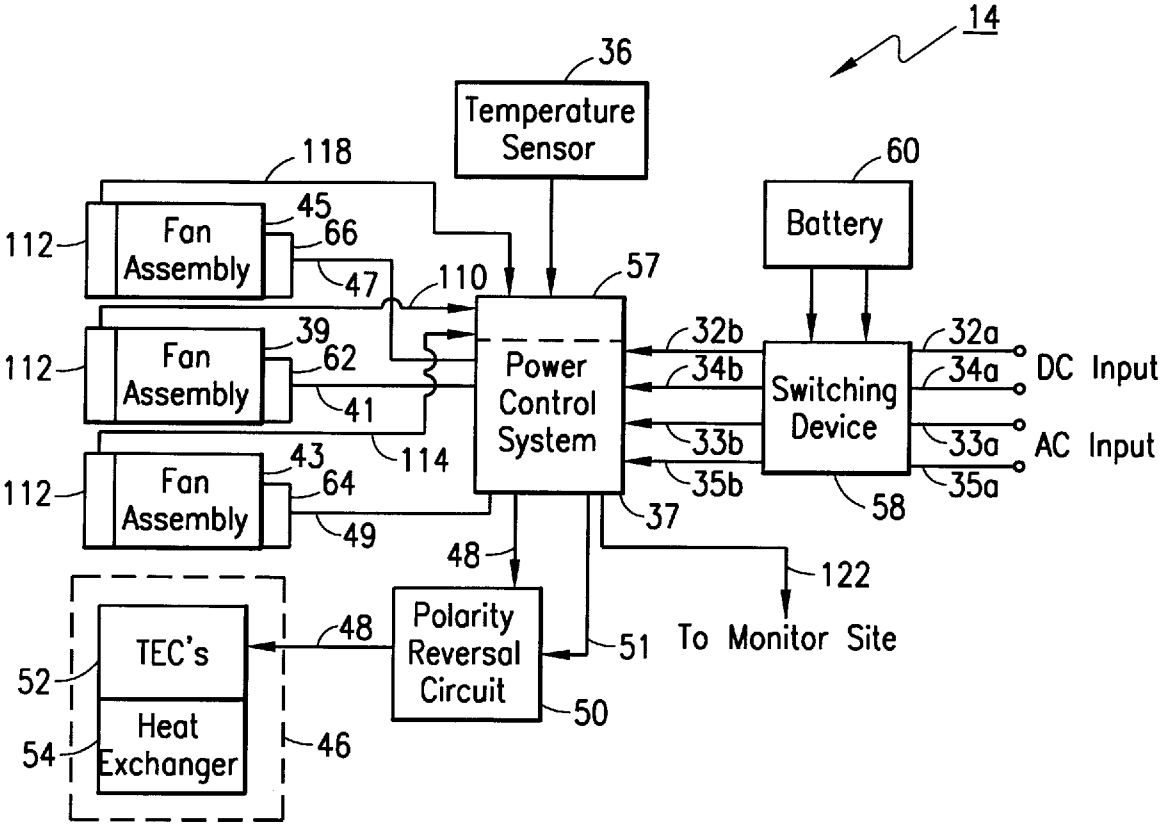
FIG. 6 is an electrical diagram of another embodiment of the thermoelectric temperature control system of the present invention.

Referring now to FIG. 6, a diagram illustrating on embodiment of a thermoelectric temperature control system 14 of the present invention. The thermoelectric temperature control system 14 illustrated in FIG. 6 generally comprises the power control system 37, a temperature sensor 36, a polarity reversal circuit 50, a switching device 58, and a battery 60. The switching device 58 receives input power of a DC voltage on leads 32*a* and 34*a* and an AC voltage on leads 33*a* and 35*a*, from the electrical power source 19 in enclosure 20. The switching device 58 is also connected to the battery 60. The switching device 58 provides DC voltage to the power control system 37 through leads 32*b* and 34*b*, and an AC voltage to the power control system 37 through leads 33*b* and 35*b*. In a preferred embodiment, the switching device 58 is a normally open relay operatively connected such that when DC power from the electrical power source 19 fails the switching device 58 connects battery 60 to provide DC voltage to the power control system 37 so that the thermoelectric temperature control system 14 will remain operable when the operation of the fans are required during a DC power failure of the electrical power source 19. It is preferred that the battery 60 is either a 24 volt DC or a 48 volt DC.

Still referring to FIG. 6, the power control system 37 provides the power and control thereof to the fan assembly 39 through a fan speed control 62 via leads or cable 41, provides the power and control thereof to the fan assembly 43 through a fan speed control 64 via leads or cable 49, and provides the power and control thereof to the fan assembly 45 through a fan speed control 66 via leads or cable 47. It will be appreciated that each fan assembly can be controlled separately so that all fan assemblies can be on at the same time at different speeds, all fan assemblies can be off at the same time, or each fan assembly can be on at different times and at different speeds. The fan assembly 39 provides movement of the air from the enclosure 20 through an internal chamber portion or section of the passive heat exchanging system 12 as illustrated in FIGS. 4 and 5. The fan assembly 43 provides movement of the ambient or outside air through an external chamber portion or section of the passive heat exchanging system 12 as illustrated in FIGS. 4 and 5. The fan assembly 45 also provides movement of the ambient or outside air through the external chamber portion or section of the passive heat exchanging system 12 as illustrated in FIGS. 4 and 5.

Referring still to FIG. 6, the power control system 37 also provides the power and control thereof to thermoelectric assembly 46 via leads or cable 48, which passes through polarity reversal circuit 50. Polarity reversal circuit 50 reverses the polarity of the DC voltage applied to the thermoelectric assembly 46 if it is desired for the thermoelectric assembly 46 to provide heating rather that cooling. The position or state of the polarity reversal circuit 50 is determined and controlled by the signal sent from the power control system 37 via lead 51. The thermoelectric assembly 46 comprises thermoelectric devices 52 operatively mounted to heat exchanger 54.

Referring still to FIG. 6, the power control system 37 receives an input via leads or cable 110 from speed or rpm sensor 112, which is operatively positioned with respect to fan assembly 39, with the input being indicative of the speed or rpm of fan assembly 39. The power control system 37 also receives an input via leads or cable 114 from speed or rpm sensor 116, which is operatively positioned with respect to fan assembly 43, with the input being indicative of the speed or rpm of fan assembly 43. The power control system 37 also receives an input via leads or cable 118 from speed or rpm sensor 120, which is operatively positioned with respect to fan assembly 45, with the input being indicative of the speed or rpm of fan assembly 45.

Still referring to FIG. 6, the power control system 37 includes a programmable control means 57 which is preferably a microprocessor and associated software. The programmable control means 57 receives the output from speed sensors 112, 116 and 120, and the temperature sensor 36. The programmable control means 57 causes the power control system 37 to activate thermoelectric assembly 46 when needed. The power control system 37, through appropriate software in the programmable control means 57, also monitors the inputs from the three speed or rpm sensors to determine that each of the three fan assemblies are operating at a speed within the window of speed values allowable for each fan assembly. When a fan assembly failure (a fan is not operating within the window of allowable speed values) is detected, the power control system 37 activates a warning light in enclosure 20 and also sends a summation signal over leads or cable 122 to a monitor site.

Referring still to FIG. 6, the power control system 37 preferably is one of two different designs which are available and will perform the necessary functions in the present invention. One design which can be used is that of the power control circuitry constructed in accordance with the teachings of U.S. Pat. No. 5,371,665, which is incorporated herein in its entirety by reference thereto. Another design which can be used is that of the current control circuit constructed in accordance with the teachings of U.S. patent application entitled "Current Control Circuit For Improved Power Application and Control of Thermoelectric Devices" filed Feb. 27, 1996 with Ser. No. 08/607,713, which is incorporated herein in its entirety by reference thereto.

Referring now to FIGS. 1, 4 and 6, the operation of the present invention will be discussed. Upon activation of the heat producing equipment 18 and the thermoelectric temperature control system 14 by the electrical power source, the temperature sensor 36 begins to monitor the temperature within enclosure 20. When the signal to the power control system 37, from the temperature sensor 36, indicates that the temperature of the air within enclosure 20 has reached a first predetermined value, the microprocessor and software in the power control system 37 will cause the power control system 37 to activate fan assembly 39. The warm or heated air 16 will be drawn from enclosure 20, through openings 74 and 76, pass over the passive evaporator 100 which resides in the internal chamber 92*a*, pass over the first heat exchanger 54*a* and the first side 52*a* of the thermoelectric devices 52, and then will be discharged back into enclosure 20 through openings 82 and 80. It will be appreciated that during the flow of the warm or heated air 16 some of the heat therein will be transferred to the passive evaporator 100 and then be transferred to the passive condenser 102 which resides on the outside-air side of wall 92.

Still referring to FIGS. 1, 4, and 6, if the temperature of the warm or heated air 16 continues to increase, the signal from the temperature sensor 36 will indicate that the temperature of the air within enclosure 20 has reached a second predetermined value, and the power control system 37 will activate fan assembly 43 and fan assembly 45. Fan assembly 43 will draw outside ambient air 26, through opening 86, which will be passed over passive condenser 102 and heat in the passive condenser 102 will be transferred to the ambient air 26 whereupon the warmed ambient air 28 is expelled to the outside of housing 70 through opening 85. Fan assembly 45 will cause some outside ambient air 26 to pass over that half of heat exchanger 54 which resides on the outside-air side of wall 92 and to be discharged to the outside through openings 91.

Referring still to FIGS. 1, 4, and 6, if the temperature of the warm or heated air 16 continues to increase, the signal from the temperature sensor 36 will indicate that the temperature of the air within enclosure 20 has reached a third predetermined value, and the power control system 37 will activate the thermoelectric devices 52 which will cool the first heat exchanger 54*a* and the first side 52*a* of the thermoelectric devices 52 which reside in the internal chamber 92*a* of the enclosure 20. The activation of the thermoelectric devices 52 will further cool the precooled air 22 resulting in cooled air 24. The power control system 37 will activate the thermoelectric devices 52 in a cyclic manner to keep the air in enclosure 20 below the maximum allowed value. It will be appreciated that the power control system 37 may keep fan assembly 39 activated and running all the time depending upon the requirements of the operation and installation.

Still referring to FIGS. 1, 4, and 6, if the air in enclosure 20 becomes colder than a predetermined value as indicated by the signal from the temperature sensor 36 to the power control system 37, the power control system 37 will activate the polarity reversal circuit 50. This application of a polarity reversed voltage to the thermoelectric devices 52 will result in the heating of the half of heat exchanger 54 which resides in the internal chamber 92*a* which results in the air in enclosure 20 being heated above a predetermined value. It will be appreciated that any of fan assemblies 39, 43 and 45 may be activated, if necessary.

With reference to FIGS. 1, 5 and 6, it will be appreciated that the operation and result is basically the same as that for FIGS. 1, 4 and 6. With respect to FIG. 5, it will be appreciated that fan assembly 45 and that portion of heat exchanger 54, which resides on the ambient air side of wall 92 of housing 70, have been replaced by passive evaporator 106 with the heat being removed from the hot side of the thermoelectric devices 52 by the passive evaporator 106 rather than ambient air moving over the surface of an air-to-air heat exchanger. The treatment of the air from and to the enclosure 20 side of wall 92 of housing 70 is the same as was described with respect to FIG. 4

Figure 7:
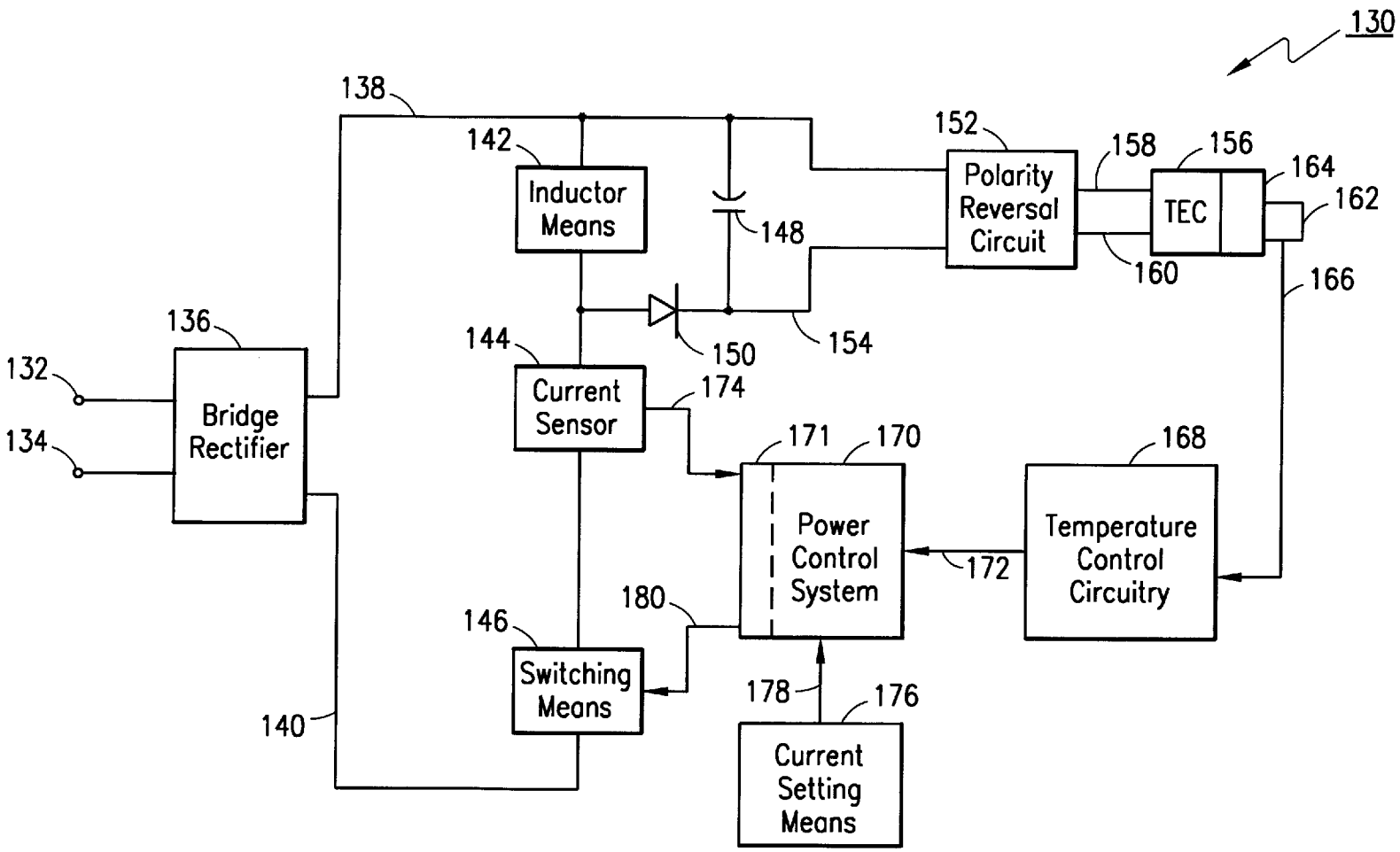
FIG. 7 is an electrical diagram of a current control circuit for supplying power to and temperature control of thermoelectric cooling devices.

Referring now to FIG. 7, another embodiment of a current control circuit 130, with a buck-boost topology, for supplying power to thermoelectric cooling devices and improved temperature control of the thermoelectric cooling devices is shown. Current control circuit 130 may be used in the thermoelectric temperature control system 14 of the present invention to provide power to the thermoelectric devices 52. Three important features of the present inventive current control circuit are 1) universal power input, 2) boost-buck topology for enabling the use of the present inventive circuit with high Vmax thermoelectric devices or with low Vmax thermoelectric devices and 3) higher power factor since the circuit is receiving current directly from the input lines and does not have a filter capacitor after the bridge rectifier as is typical in universal power circuits.

Still referring to FIG. 7, the current control circuit 130 comprises a pair of terminals 132 and 134 for receiving an AC or a DC input voltage. The AC input voltage may be any value between 80 VAC to 250 VAC at 50, 60 or 400 Hz. The DC input voltage may be any value between 80 VDC to 250 VDC. For a DC input voltage, terminal 130 is the plus terminal and terminal 132 is the negative terminal. A bridge rectifier 136 is operatively connected across terminals 132 and 134. The output of bridge rectifier 136 is connected across leads or lines 138 and 140. A series circuit comprising an inductor means 142, a current sensor 144 and a switching means 146 is connected across leads or lines 138 and 140. Inductor means 142 may comprise an iron core inductor. Current sensor 144 may comprise a operatively connected transformer or a hall-effect sensor and the switching means 146 may comprise a high current or high power transistor.

Referring still to FIG. 7, a series circuit comprising capacitor 148 and diode 150 is connected across inductor means 142. A polarity reversal circuit 152 is connected across capacitor 148 via leads or lines 138 and 154. The output of the polarity reversal circuit 152 is connected across one or more thermoelectric (TEC) devices 156 (such as the thermoelectric devices 52 in FIGS. 2, 3, 4, 5, or 6) via leads or lines 158 and 160.

Still referring to FIG. 7, a temperature sensor 162 is operatively attached to a heat exchanger 164 (such as the heat exchanger 54 in FIGS. 2, 3, 4, 5, or 6) which is operatively positioned with respect to the one or more thermoelectric devices 156. A fan (not shown) is used to blow air across the heat exchanger 164 to provide the cooling air for the function desired. Temperature sensor 162 provides a signal over lead or line 166 to the temperature control circuitry 168. The signal over lead or line 168 provides a relative indication of the temperature of the one or more thermoelectric devices 156 and the heat exchanger 164. The output of the temperature control circuitry 168 is provided to the power control system 170 via lead or line 172. The power control system 170 also receives an output from current sensor 144 via lead or line 174 and an output from the current setting means 176 via lead or line 178. The current setting means 176 sets the maximum current that the current controlled power supply will allow to flow through inductor means 142. The maximum current value set by the power control system 170 is determined by the output from the current setting means 176. In the basic embodiment, the current setting means 176 comprises a resistive element. The maximum current value is determined by the type of TEC, the number of TECs and the circuit configuration (series, parallel or a combination of series/parallel) of the TEC devices. The power control system 170 includes programmable control means 171 which comprises a microprocessor and appropriate software (such as a PID control loop). Power control system 170 provides an output signal to switching means 146 via lead or line 180. The output signal from the power control system 170 comprises a PWM (pulse width modulated) type signal to drive the switching means 146 to the "ON" or conducting condition. The wider the width of the pulse signal, the longer the switching means is in the "ON" condition.

Referring still to FIG. 7, in operation, the desired "set point" temperature has been input to the programmable control means 171 and the desired voltage of 80 to 250 volts AC (50, 60 or 400 Hz) or DC is applied at terminals 132 and 134. The signal from the temperature sensor 162 sends a signal to the temperature control circuitry 168 which sends a signal to the power control system 170 providing an indication that the temperature of the one or more TEC devices 156 is above the "set point" temperature. Power control system 170 will output a PWM signal to the switching means 146 to place the switching means 146 in the "ON" condition and cause current to flow through the inductor means 142. Based upon the input from the temperature control circuitry 168 and from the current setting means 176, the power control system 170 will determine when to deactivate switching means 146 to the "OFF" or non-conducting condition.

Still referring to FIG. 7, during the time that switching means 146 is in the "ON" condition, current flows through inductor means 142 and energy is stored in the generated magnetic field associated with inductor means 142. When switching means 146 is placed in the "OFF" condition, the magnetic field collapses and generates a voltage across inductor means 142. This voltage charges capacitor 148 which supplies a smooth DC voltage to the one or more thermoelectric devices 156.

Referring still to FIG. 7, power is stored in the inductor means 142 during the "ON" time of switching means 146 and is transferred to capacitor 148 during the "OFF" time of switching means 146. This is the buck-boost configuration. The topology with the inductor means 142, diode 150 and capacitor 148 and one or more thermoelectric devices 156 (the load) provides the buck-boost of the voltage applied to the one or more thermoelectric devices 156.

Still referring to FIG. 7, if the input voltage to input terminals 132 and 134 is higher than the voltage requirement for the one or more thermoelectric devices 156, the power control system will place switching means 146 in the "ON" condition for a shorter period of time so that less energy will be stored in inductor means 142 which will result in a voltage being applied to the one or more thermoelectric devices 156 which is less than the applied input voltage. This is the buck mode of the current controlled power supply 130. This inventive current controlled power supply 130 provides tighter control when the voltage to be applied to the one or more thermoelectric devices 156 is less than the applied input voltage by providing the ability in the power control system 170 to apply the minimum pulse width signal to the switching means 146 at a rate less than the base PWM frequency by pulse skipping and thereby allowing less pulses to be sent to the switching means 146 for a given period of time.

Referring still to FIG. 7, if the input voltage to input terminals 132 and 134 is lower than the voltage requirement for the one or more thermoelectric devices 156, the power control system will place switching means 146 in the "ON" condition for a longer period of time so that more energy will be stored in inductor means 142 which will result in a voltage being applied to the one or more thermoelectric devices 156 which is higher than the applied input voltage. This is the boost mode of the current controlled power supply 130. The amount of energy stored in inductor means 142 and the resulting value of voltage applied to the one or more thermoelectric devices 156 depends upon the length of time switching means 146 is in the "ON" condition (how wide the pulse is that the power control system 170 sends to switching means 146).

Still referring to FIG. 7, the inventive current controlled power supply 130 provides a higher power factor when the input voltage is AC. Where the voltage on the rectified AC waveform is at the lower voltage location, power control system 170 places switching means 146 in the "ON" condition for a longer period of time in order to store more energy in inductor means 142. When the voltage on the rectified AC waveform is at the higher voltage location, power control system 170 places switching means 146 in the "ON" condition for a shorter period of time. Current controlled power supply 130 can determine the amount of energy to be stored in inductor means 142 at any point on the rectified AC waveform (except where the rectified AC waveform goes to zero) by varying the "ON" time of switching means 146.

From the foregoing detailed description, it can be appreciated that the present invention is capable of conditioning the air in an enclosure which shelters heat producing equipment by precooling the air by employing a low cost passive heat removal system to remove heat in conjunction with a thermoelectric temperature control system which achieves the necessary temperature control. The present invention is also capable of supplying power to and temperature control of thermoelectric cooling devices. The method of precooling the air using a passive heat removal system reduces the need for a large number of thermoelectric devices thus reducing the cost of such systems while making them energy efficient.

While particular embodiments of the present invention have been described, it will be appreciated by those skilled in the art that various modifications, alternatives, variations, etc., may be made without departing from the spirit and scope of the invention as defined in the appended claims.

What is claimed is:

1. A system for conditioning the air within an enclosure which houses heat producing equipment which is activated by an electrical power source, said system comprising:

a passive heat removal system for receiving and cooling warm air produced by the heat producing equipment within the enclosure and returning the cooled air to the heat producing equipment and transferring the heat from the warm air to the outside of the enclosure, said passive heat removal system comprising a heat pipe system spaced from said heat producing equipment;

at least one thermoelectric assembly for receiving and further cooling the cooled air from the passive heat removal system and returning the further cooled air to the heat producing equipment and transferring the heat from the cooled air to the outside of the enclosure, said at least one thermoelectric assembly being spaced from said heat producing equipment;

a power control system for activating the at least one thermoelectric assembly to maintain the temperature of the air within the enclosure below a predetermined value determined for the heat producing equipment; and sensor means positioned within the enclosure to monitor the temperature of the air within the enclosure and connected to provide an input to the power control system indicative of the temperature of the air within the enclosure.

2. The system as set forth in claim 1 wherein said heat pipe system includes at least one passive evaporator operatively connected to at least one passive condenser.

3. The system as set forth in claim 1 further including means for moving the air within the enclosure.

4. The system as set forth in claim 3 wherein said means for moving the air comprises at least one fan.

5. The system as set forth in claim 4 wherein the activation of said at least one fan is controlled by said power control system.

6. The system as set forth in claim 1 further including means for moving the air outside the enclosure.

7. The system as set forth in claim 6 wherein said means for moving the air comprises at least one fan.

8. The system as set forth in claim 7 wherein the activation of said at least one fan is controlled by said power control system.

9. The system as set forth in claim 1 wherein said power control system comprises programmable control means to receive an output from said sensor means and provide an output to the power control system causing said power control system to activate said at least one thermoelectric assembly, said providing of the output to the power control system being determined by the difference between the sensed temperature of the air within the enclosure and the predetermined value of temperature determined for the heat producing equipment.

10. The system as set forth in claim 9 wherein said programmable control means comprises a microprocessor and associated software.

11. The system as set forth in claim 1 wherein said at least one thermoelectric assembly comprises at least one thermoelectric device positioned between two sides of a heat exchanger.

12. The system as set forth in claim 11 wherein one side of said heat exchanger comprises a fined heat exchanger.

13. The system as set forth in claim 12 wherein said the side of said heat exchanger comprises a heat pipe system.

14. The system as set forth in claim 1 wherein said power control system receives power from said electrical power source.

15. The system as set forth in claim 14 further including a battery for providing power to said power control system if said electrical power source fails.

16. The system as set forth in claim 15 wherein said battery is a 24 volt DC battery.

17. The system as set forth in claim 15 wherein said battery is a 48 volt DC battery.

18. The system as set forth in claim 15 further including a switching device operatively connected between said electrical power source and said power control system to apply battery power to said power control system when said electrical power source fails.

19. The system as set forth in claim 14 further including a polarity reversal circuit operatively connected between said power control system and said at least one thermoelectric assembly to reverse the heat pumping of said at least one thermoelectric assembly.

20. The system as set forth in claim 4 further including means operatively connected between said at least one fan and said power control system to monitor the speed of said at least one fan.

21. The system as set forth in claim 20 further including means to indicate a failure of said at least one fan.

22. The system as set forth in claim 7 further including means operatively connected between said at least one fan and said power control system to monitor the speed of said at least one fan.

23. The system as set forth in claim 22 further including means to indicate a failure of said at least one fan.

24. A method of conditioning the air within an enclosure which houses heat producing equipment which is activated by an electrical power source, said method comprising the steps of:

providing a passive heat removal system comprising a heat pipe system disposed in spaced relationship from said heat producing equipment and adapted for receiving and cooling warm air produced by the heat producing equipment within the enclosure and returning the cooled air to the heat producing equipment and transferring the heat from the warm air to the outside of the enclosure;

providing at least one thermoelectric assembly disposed in spaced relationship from said heat producing equipment and adapted for receiving and further cooling the cooled air from the passive heat removal system and returning the further cooled air to the heat producing equipment and transferring the heat from the cooled air to the outside of the enclosure;

determining the temperature of the air within the enclosure;

providing a power control system to receive an indication of said temperature of the air within the enclosure and for activating the at least one thermoelectric assembly to maintain the temperature of the air within the enclosure below a predetermined value determined for the heat producing equipment.

25. The method as set forth in claim 24 wherein said heat pipe system includes at least one passive evaporator operatively connected to at least one passive condenser.

26. The method as set forth in claim 24 further including the step of providing means for moving the air within the enclosure.

27. The method as set forth in claim 26 wherein said means for moving the air comprises at least one fan.

28. The method as set forth in claim 27 wherein the activation of said at least one fan is controlled by said power control system.

29. The method as set forth in claim 24 further including the step of providing the means for moving the air outside the enclosure.

30. The method as set forth in claim 29 wherein said means for moving the air comprises at least one fan.

31. The method as set forth in claim 30 wherein the activation of said at least one fan is controlled by said power control system.

32. The method as set forth in claim 24 wherein said power control system comprises programmable control means to receive the indication of said temperature of the air within the enclosure and provide an output to the power control system causing said power control system to activate said at least one thermoelectric assembly, said providing of the output to the power control system being determined by the difference between the determined temperature of the air within the enclosure and the predetermined value of temperature determined for the heat producing equipment.

33. The method as set forth in claim 32 wherein said programmable control means comprises a microprocessor and associated software.

34. The method as set forth in claim 24 wherein said at least one thermoelectric assembly comprises at least one thermoelectric device positioned between two sides of a heat exchanger.

35. The method as set forth in claim 34 wherein one side of said heat exchanger comprises a finned heat exchanger.

36. The method as set forth in claim 35 wherein the other side of said heat exchanger comprises a heat pipe system.

37. The method as set forth in claim 24 wherein said power control system receives power from said electrical power source.

38. The method as set forth in claim 37 further including the step of providing a battery for providing power to said power control system if said electrical power source fails.

39. The method as set forth in claim 38 wherein said battery is a 24 volt DC battery.

40. The method as set forth in claim 38 wherein said battery is a 48 volt DC battery.

41. The method as set forth in claim 38 further including the step of providing a switching device operatively connected between said electrical power source and said power control system to apply battery power to said power control system when said electrical power source fails.

42. The method as set forth in claim 37 further including the step of providing a polarity reversal circuit operatively connected between said power control system and said at least one thermoelectric assembly to reverse the heat pumping of said at least one thermoelectric assembly.

43. The method as set forth in claim 27 further including the step of providing means operatively connected between said at least one fan and said power control system to monitor the speed of said at least one fan.

44. The method as set forth in claim 43 further including the step of providing means to indicate a failure of said at least one fan.

45. The method as set forth in claim 30 further including the step of providing means operatively connected between said at least one fan and said power control system to monitor the speed of said at least one fan.

46. The method as set forth in claim 45 further including the step of providing means to indicate a failure of said at least one fan.

* * * * *